US008960297B1

(12) United States Patent
Pinson

(10) Patent No.: US 8,960,297 B1
(45) Date of Patent: Feb. 24, 2015

(54) WELL CLEANOUT TOOL

(71) Applicant: Daman E. Pinson, Odessa, TX (US)

(72) Inventor: Daman E. Pinson, Odessa, TX (US)

( * ) Notice: Subject to any disclaimer, the term of this patent is extended or adjusted under 35 U.S.C. 154(b) by 0 days.

(21) Appl. No.: 14/339,368

(22) Filed: Jul. 23, 2014

(51) Int. Cl.
*E21B 37/00* (2006.01)

(52) U.S. Cl.
CPC ..... *E21B 37/00* (2013.01)
USPC ..... 166/311; 166/173; 166/222

(58) Field of Classification Search
CPC ..... E21B 37/04; E21B 37/00; E21B 31/00; E21B 31/03
USPC ..... 166/311, 171, 178, 301, 173, 99, 222, 166/243
See application file for complete search history.

(56) References Cited

U.S. PATENT DOCUMENTS

| | | | | | |
|---|---|---|---|---|---|
| 2,290,141 | A * | 7/1942 | Burt | ..... | 166/312 |
| 4,625,799 | A * | 12/1986 | McCormick et al. | ..... | 166/223 |
| 4,744,420 | A * | 5/1988 | Patterson et al. | ..... | 166/312 |
| 4,919,204 | A * | 4/1990 | Baker et al. | ..... | 166/223 |
| 5,158,140 | A * | 10/1992 | Ferry | ..... | 166/312 |
| 5,195,585 | A * | 3/1993 | Clemens et al. | ..... | 166/222 |
| 6,029,746 | A * | 2/2000 | Dodd | ..... | 166/312 |
| 7,011,158 | B2 * | 3/2006 | Davis et al. | ..... | 166/312 |

* cited by examiner

*Primary Examiner* — Yong-Suk (Philip) Ro
(74) *Attorney, Agent, or Firm* — Buskop Law Group, PC; Wendy Buskop

(57) ABSTRACT

A well cleanout tool configured to replace a joint of tubing in a multi-joint tubing string for a wellbore. The well cleanout tool having a bushing threadable to a tubular and a one piece integral nozzle threaded to the tubular opposite the bushing, with an inner gas separator assembly contained within the tubular for flowing particulate out the nozzle end and cleaned wellbore fluid out the bushing end.

7 Claims, 3 Drawing Sheets

WELL CLEANOUT TOOL

FIELD

The present embodiments generally relate to a wellbore cleaning tool configured to replace a joint of tubing in a multi-joint tubing string for cleaning out a wellbore that is removing particulate from wellbore fluid while installed in a wellbore producing cleaned wellbore fluid in the wellbore.

BACKGROUND

A need exists for a well cleaning tool configured to replace a joint of tubing in a multi-joint tubing string for a wellbore and prevent gas lock and explosion while separating particulate from wellbore fluid and producing cleaned wellbore fluid.

The present embodiments meet these needs.

BRIEF DESCRIPTION OF THE DRAWINGS

The detailed description will be better understood in conjunction with the accompanying drawings as follows.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

A benefit of the invention is that it reduces gas in the wellbore fluid which reduces the need for maintenance to equipment of a bottom hole assembly.

A benefit of the invention is that it creates an overall safer work environment at a pump site.

Gas destroys equipment quickly and stops pumps from running. The present invention keeps pump running longer.

Workover rigs with this device installed are expected to continue to operate at least 20 percent longer than rigs without this device.

The invention reduces gas and particulates in the fluid and reduces the possibility of explosions that result in toxic spills that damage aquifers and kill local fauna.

Figure 1:
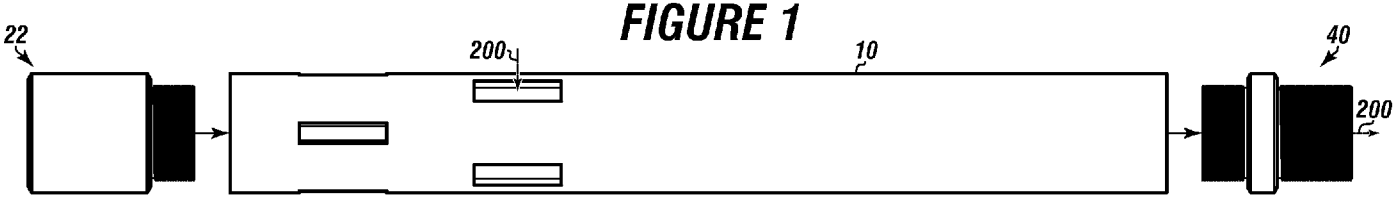
FIG. 1 depicts an exploded view of the well cleanout tool.

Turning now to the Figures, FIG. 1 depicts an exploded view of a well cleanout tool.

The well cleanout tool 8 can comprise a tubular 10, a nozzle 40 and a bushing 22 which, when assembled, can form a well cleanout tool configured to replace a joint of tubing in a multi-joint tubing string for a wellbore. The nozzle can be a one piece integral nozzle.

The tubular 10 can include a plurality of perforations 16*a*-16*h* solely in the upper half of the tubular. The bushing 22 can be connected on the end of the tubular with perforations. The nozzle 40 can be connected on an opposite end of the tubular from the bushing. The bushing 22 can engage a first joint of tubing of a multi-joint tubing string and the nozzle 40 can join a second joint of tubing of the multi-joint tubing string.

Wellbore fluid 200 can flow from a wellbore in through the perforations 16*a*-16*h* with particulate 201 dropping out of the nozzle 40 to the second joint of tubing and cleaned wellbore fluid 203 flowing out of the bushing to the first joint of tubing.

Figure 2:
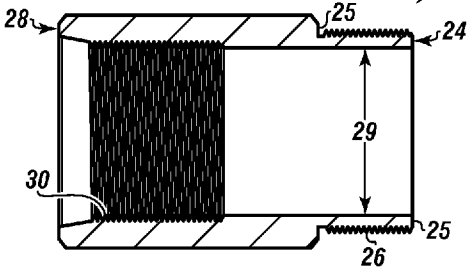
FIG. 2 depicts a cross sectional view of the bushing.

FIG. 2 depicts a cross sectional view of the bushing.

In embodiments, the bushing can have a length from 3 inches to 10 inches, an outer diameter from 3 inches to 8 inches, and an inner diameter from 1 inch to 8 inches. In embodiments, the bushing can be made from steel, brass, or an alloy of steel.

The bushing 22 can threadably engage the first threaded inner end of the tubular.

The bushing 22 can have a pin end 24 with a seal face 25 adjacent outer straight threads 26. In embodiments, the outer straight threads can be from 8 threads to 16 threads per inch. The seal face 25 can form a first metal to metal seal with the tubular when the pin end is threaded to the tubular using the outer straight threads. The pin end 24 can also have a pin end inner diameter 29.

The bushing can have a box end 28 integral with the pin end 24. The box end 28 can have inner tapered threads 30 for forming a second metal to metal seal with a first joint of tubing of the multi-joint tubing string. In embodiments the inner tapered threads can be from 8 threads to 16 threads per inch. In embodiments, the inner tapered threads can be rounded threads.

Figure 3:
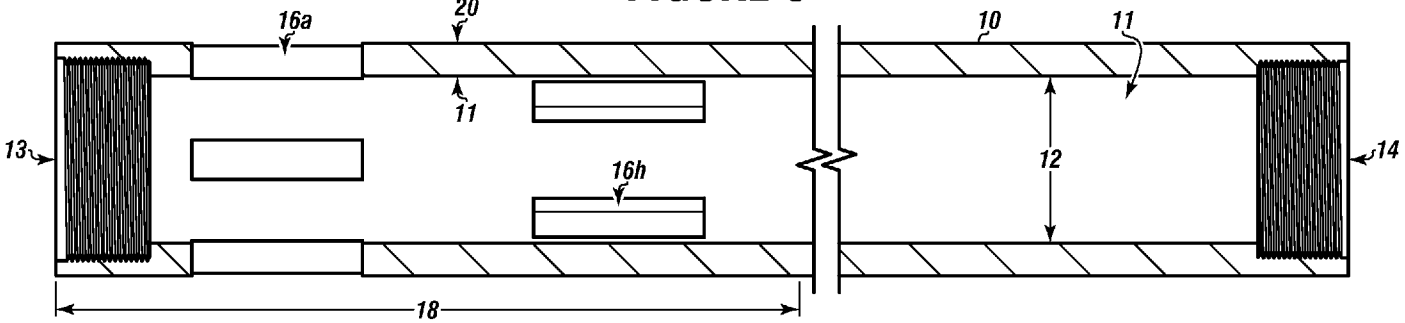
FIG. 3 depicts a cross sectional view of the tubular.

FIG. 3 depicts a cross sectional view of the tubular.

In embodiments, the tubular 10 can have a length from 3 feet to 24 feet. In embodiments, the tubular can be made from brass, steel, or an alloy of steel, including stainless steel.

The tubular 10 can have an inner bore 11 with an inner diameter 12. In embodiments, the inner diameter can be from 1 inch to 8 inches.

The tubular 10 can have a first threaded inner end 13 and a second threaded inner end 14. The first threaded inner end 13 can be formed to match the outer straight threads of the bushing. The second threaded inner end 14 can be formed with threads that match the pin end outer surface straight threads of the nozzle, which are shown in FIG. 4.

The tubular 10 can have a plurality of perforations 16*a*-16*h*. The plurality of perforations can be formed solely in the upper half 18 of the tubular. In embodiments, from 1 perforation to 20 perforations can be formed in the upper half 18 of the tubular. In embodiments, the perforations can have at least one of: a rectangular shape, a square shape, a circular shape, an ellipsoid shape, a half-moon shape and a zebra shape. In embodiments, the perforations can have tapered or beveled edges. In embodiments, each perforation can have a diameter from ⅛ of an inch to 2 inches. The plurality of perforations piercing the tubular can go through the wall of the tubular completely from an outer side 20 to the inner bore 11.

Figure 4:
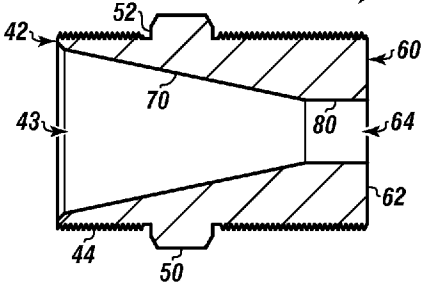
FIG. 4 depicts a cross sectional view of the nozzle.

FIG. 4 depicts a cross sectional view of the nozzle.

The nozzle 40 can have a tubular pin end 42 with a pin opening 43 and pin end outer surface straight threads 44. The nozzle 40 can engage the tubular with the tubular pin end 42 and can also engage a second joint of tubing of a multi-joint tubing string simultaneously using a tapered pin end 60 of the nozzle.

The nozzle 40 can have a shoulder 50 with a pin end seal face 52 adjacent the pin end outer surface straight threads 44.

The pin end seal face 52 can form a second metal to metal seal when the tubular pin end is threaded onto the second threaded inner end of the tubular.

The tapered pin end 60 can have a flat face 62 with a tapered pin opening 64. The tapered pin end 60 can be integrally connected with the shoulder 50 opposite the tubular pin end 42. The tapered pin end 60 can have tapered pin end outer surface threads 63.

The nozzle 40 can have a conical funnel 70 formed longitudinally through the nozzle. The conical funnel 70 can comprise the pin opening 43 formed in the tubular pin end 42 that is larger in diameter than a funnel opening 71 formed proximate to the tapered pin end 60. The pin opening 43 can be 30 percent to 200 percent larger than the funnel opening 71. The conical funnel 70 can receive and trap particulate from wellbore fluid entering the tubular through the plurality of perforations.

The nozzle 40 can have a cylindrical conduit 80 communicating between the tapered pin opening 64 and the conical funnel 70 for trapping received particulate from the conical funnel.

Figure 5:
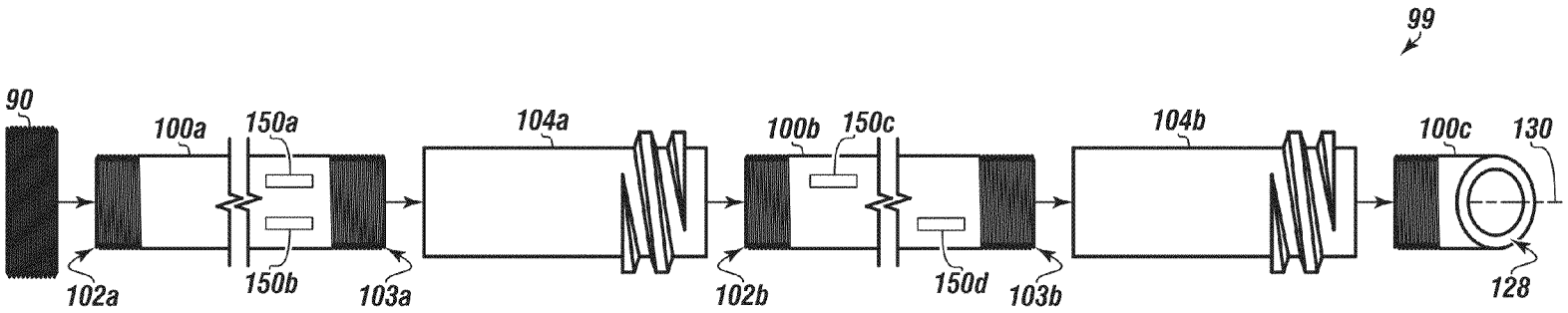
FIG. 5 depicts an exploded view of an inner gas separator assembly.
Figure 7:
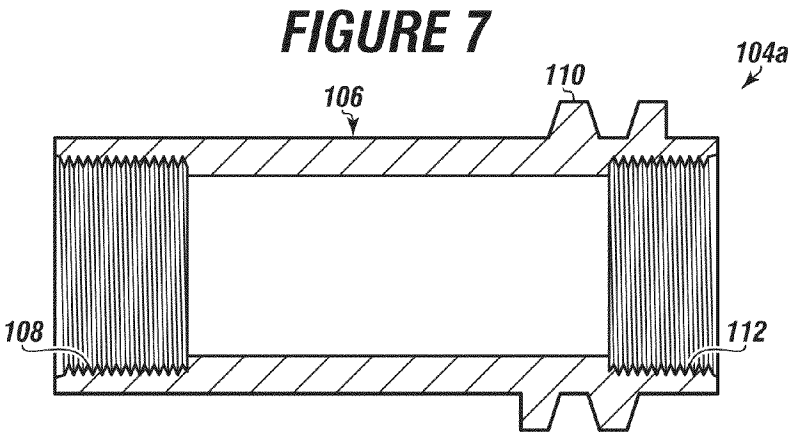
FIG. 7 depicts a detailed view of the first separator coupling.
Figure 6:
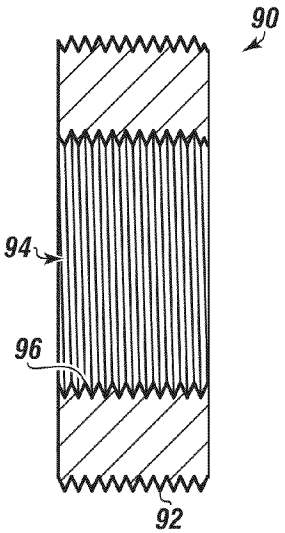
FIG. 6 depicts a detailed view of a dip tube hanging plate.

FIG. 5 depicts an exploded view of an inner gas separator assembly. FIG. 6 depicts a detailed view of a dip tube hanging plate. FIG. 7 depicts a detailed view of the first separator coupling.

Referring to FIGS. 5, 6 and 7, the inner gas separator assembly 99 can comprise a dip tube hanging plate 90, a first dip tube 100*a*, a first separator coupling 104*a*, a second dip tube 100*b*, a second separator coupling 104*b*, and a third dip tube 100*c*.

The dip tube hanging plate 90 can have external threads 92 for securing to the inner bore of the tubular. The dip tube hanging plate 90 can also have a central opening 94 with central opening threads 96.

The first dip tube 100*a* can have a first outer threaded end 102*a* for engaging the central opening threads 96 of the dip tube hanging plate 90 and a second outer threaded end 103*a*.

The first separator coupling 104*a* can have an outer surface 106. The first separator coupling 104*a* can have first inner threads 108 for engaging the second outer threaded end 103*a* of the first dip tube 100*a*. The first separator coupling 104*a* can have a helical ridge 110 extending from the outer surface 106 to fit within the tubular and configured to form a separation between the inner bore of the tubular of less than 1 inch and to create a vortex with the wellbore fluid flowing into the tubular through the plurality of perforations keeping particulates suspended in the wellbore fluid. The first separator coupling 104*a* can also have second inner threads 112.

The second dip tube 100*b* can have a first outer threaded end 102*b* for engaging the second inner threads 112 of the first separator coupling 104*a* and a second outer threaded end 103*b*.

The second separator coupling 104*b* can be connected to the second outer threaded end 103*b* of the second dip tube 100*b*.

The third dip tube 100*c* can be connected to the second separator coupling 104*b*. The third dip tube 100*c* can have an angled end 128 opposite the threaded portion that engages the second separator coupling. The angled end can be at a 45 degree angle from a longitudinal axis 130 of the third dip tube.

A plurality of stabilizers 150*a*-150*d* can be mounted to each dip tube. Each stabilizer can have a length of 1 inch and can be formed from a ¾ inch steel bar welded longitudinally around the circumference of the dip tube.

In embodiments, the plurality of stabilizers 150*a*-150*d* can be mounted on to each dip tube, the separator couplings, or combinations thereof.

Figure 8:
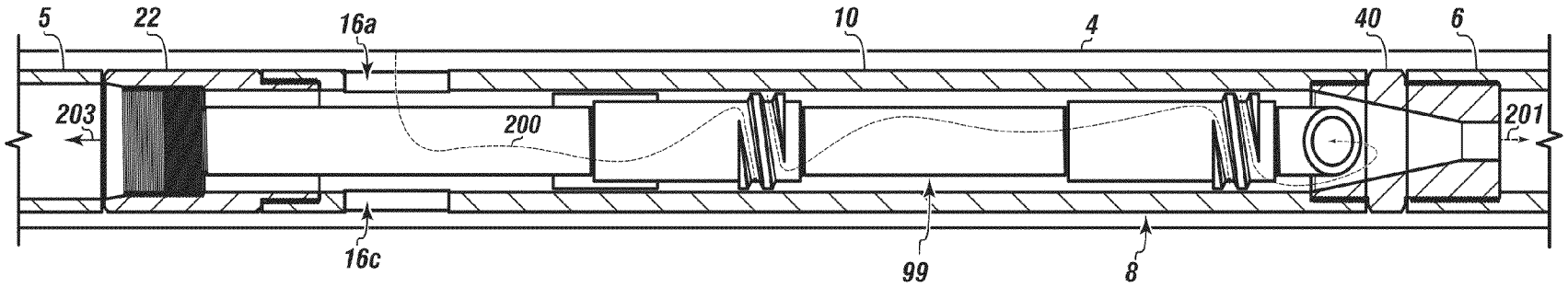
FIG. 8 depicts an assembled well cleanout tool installed between a first joint of tubing and a second joint of tubing in a wellbore.

FIG. 8 depicts an assembled well cleanout tool installed between a first joint of tubing and a second joint of tubing in a wellbore.

The well cleanout tool 8 is shown in a wellbore 4. The bushing 22 is shown connected to the tubular 10. The tubular 10 is shown with a plurality of perforations 16*a* and 16*c* in the upper half of the tubular for allowing wellbore fluid 200 to flow into the tubular.

The nozzle 40 is shown threaded to the tubular 10 on an end opposite the bushing 22 allowing wellbore fluid that flows around the exterior of the inner gas separator assembly 99 to then drop particulate in the nozzle 40 allowing cleaned wellbore fluid 203 to flow up the center of the dip tubes and separator couplings.

Particulate 201 is shown flowing from the nozzle 40 to the second joint of tubing 6 and cleaned wellbore fluid 203 is shown flowing to the first joint of tubing 5.

In embodiments, the perforations are only in the upper half of the tubular. In embodiments, the perforations can extend longitudinally down the upper half 3 inches to 8 inches. In embodiments, the perforation diameters can range from ¼ inch to ¾ inch.

In embodiments, the pin end can have a thread relief between the outer straight threads and the box end. In embodiments, the pin end inner diameter can be from 2 inches to 4 inches.

In embodiments, the box end outer diameter can be from 3 inches to 6 inches. In embodiments, the box end inner diameter can be 2 percent to 10 percent less than the outer diameter of the box end.

In embodiments, the tapered pin end can be tapered 1 inch per 10 inches. In an embodiment, the tapered pin end can be a standard 2 and ⅞ inch 8 round taper thread.

In embodiments, the conical funnel can extend 60 percent to 75 percent through the nozzle.

The tubular can have a length from 4 feet to 24 feet. The nozzle can have a length from 4 inches to 10 inches. The bushing can have a length from 4 inches to 10 inches. The tubular, the nozzle and the bushing can all be made from the same non-rusting, non-deformable material. In embodiments the tubular, the nozzle and the bushing can be a non-magnetic material to reduce weight or provide lower magnetic properties. In embodiments the tubular, the nozzle and the bushing can be made from at least one of: steel, stainless steel, brass, and plastic coated metal.

To assemble the invention, first the nozzle can be attached to the tubular. The points of contact where the nozzle meets the tubular can then be welded forming weld connections.

Next, an inner gas separator assembly can be assembled by first attaching a first separator coupling to a first dip tube. Then, a second dip tube can be attached to the first separator coupling.

Sequentially, a second separator coupling can be threaded to the second dip tube. Additional dip tubes and separator couplings can be used depending on the length of the tubular that is used.

Next, a third dip tube can be attached to the second separator coupling. Then, the dip tube hanging plate can be attached to the first dip tube. All connections can then be welded.

The assembler can then slide the assembled dip tube with welded separator couplings inside the tubular. The dip tube hanging plate can then be screwed into the tubular on one end, the end that also receives the bushing. The dip tube hanging plate can then be welded to the tubular.

The bushing can be threaded into the tubular over the dip tube hanging plate. The bushing can then be welded to the tubular.

Tongs can be used on the rig to secure the nozzle to a second joint of tubing. Using tongs, a first joint of a tubing can be attached to the bushing.

The tubing string with tubular can then be run into a wellbore.

Wellbore fluid can then flow through perforations in the tubular down to the nozzle trapping particulate spewing particulate out the nozzle to the second joint of tubing and enabling cleaned wellbore fluid to flow up the bore of the inner gas separator assembly and out the bushing into the first joint of tubing of the multi-joint tubing string for collection at the surface.

In embodiments, the inner diameter of each dip tube can be from 1 inch to 2 inches. In embodiments, the outer diameter of each dip tube can range from 1 inch to 3 inches, and can be 30 percent to 80 percent smaller than the inner diameter of the tubular.

While these embodiments have been described with emphasis on the embodiments, it should be understood that within the scope of the appended claims, the embodiments might be practiced other than as specifically described herein.

What is claimed is:

1. A well cleanout tool configured to replace a joint of tubing in a multi-joint tubing string for a wellbore, the well cleanout tool comprising:

a. a tubular with an inner bore with an inner diameter, a first threaded inner end, a second threaded inner end, and a plurality of perforations, piercing the tubular solely in an upper half of the tubular from an outer side to the inner bore;

b. a bushing for threadably engaging the first threaded inner end of the tubular simultaneously while engaging a first joint of tubing of the multi-joint tubing string, the bushing comprising:

(i) a pin end with a seal face adjacent outer straight threads, wherein threading the pin end to the tubular causes the seal face to form a first metal to metal seal with the tubular, the pin end further having a pin end inner diameter; and (ii) a box end integral with the pin end, the box end having inner tapered threads for forming a second metal to metal seal with the first joint of tubing of the multi-joint tubing string; and c. a nozzle comprising:

(i) a tubular pin end with a pin opening and pin end outer surface straight threads, the pin end outer surface straight threads engaging the tubular;

(ii) a shoulder having a pin end seal face adjacent the pin end outer surface straight threads, wherein engaging the tubular pin end to the tubular causes the pin end seal face to form a second metal to metal seal with the tubular;

(iii) a tapered pin end having a flat face and tapered pin end outer surface threads with a tapered pin opening, the tapered pin end integral with the shoulder opposite the tubular pin end, the tapered pin end threadably engaging a second joint of tubing of the multi-joint tubing string enabling the nozzle to simultaneously engage the second joint of tubing of the multi-joint tubing string and the tubular;

(iv) a conical funnel formed longitudinally through the nozzle with the pin opening formed in the tubular pin end having a larger diameter than a funnel opening formed proximate to the tapered pin end; and (v) a cylindrical conduit communicating between the tapered pin opening and the conical funnel for trapping particulate and flowing particulate from wellbore fluid entering the tubular through the plurality of perforations in the tubular to the second joint of tubing of the multi-joint tubing string while the bushing transfers cleaned wellbore fluid back up to the first joint of tubing of the multi-joint tubing string.

2. The well cleanout tool of claim 1, further comprising an inner gas separator assembly comprising:

a. a dip tube hanging plate with external threads for securing the dip tube hanging plate to the inner bore of the tubular, the dip tube hanging plate comprising a central opening with central opening threads;

b. a first dip tube with a first outer threaded end for engaging the central opening threads of the dip tube hanging plate and a second outer threaded end; and c. a first separator coupling comprising:

(i) an outer surface;

(ii) first inner threads for engaging the second outer threaded end of the first dip tube;

(iii) a helical ridge extending from the outer surface to fit within the tubular and the helical ridge configured to form a separation between the inner bore of the tubular of less than 1 inch and to create a vortex with the wellbore fluid flowing into the tubular through the perforations, the vortex keeping particulate suspended in the wellbore fluid; and (iv) second inner threads for engaging either a second dip tube, a third dip tube, or both the second dip tube and the third dip tube.

3. The well cleanout tool of claim 2, comprising a second separator coupling secured to the second dip tube of the inner gas separator assembly.

4. The well cleanout tool of claim 3, wherein the third dip tube has an angled end and is connected to the second separator coupling.

5. The well cleanout tool of claim 4, wherein the angled end of the third dip tube is at a 45 degree angle from a longitudinal axis of the third dip tube.

6. The well cleanout tool of claim 3, comprising a plurality of separator couplings interconnected with a plurality of dip tubes, wherein at least one dip tube of the plurality of dip tubes has an angled end and is connected to the last separator coupling of the plurality of separator couplings.

7. The well cleanout tool of claim 2, comprising a plurality of stabilizers mounted to each dip tube.

* * * * *